US009190740B2

(12) United States Patent
Wong et al.

(10) Patent No.: US 9,190,740 B2
(45) Date of Patent: Nov. 17, 2015

(54) COMMUNICATION DEVICE AND ANTENNAS WITH HIGH ISOLATION CHARACTERISTICS

(71) Applicant: Acer Incorporated, Taipei Hsien (TW)

(72) Inventors: Kin-Lu Wong, Kaohsiung (TW); Po-Wei Lin, Kaohsiung (TW)

(73) Assignee: ACER INCORPORATED, Taipei Hsien (TW)

( * ) Notice: Subject to any disclaimer, the term of this patent is extended or adjusted under 35 U.S.C. 154(b) by 192 days.

(21) Appl. No.: 13/712,136

(22) Filed: Dec. 12, 2012

(65) Prior Publication Data

US 2014/0078009 A1 Mar. 20, 2014

(30) Foreign Application Priority Data

Sep. 20, 2012 (TW) ..... 101134407 A

(51) Int. Cl.

| | |
|---|---|
| ***H01Q 21/28*** | (2006.01) |
| ***H01Q 1/52*** | (2006.01) |
| *H01Q 1/24* | (2006.01) |
| *H01Q 1/38* | (2006.01) |
| *H01Q 1/48* | (2006.01) |
| *H01Q 13/10* | (2006.01) |

(52) U.S. Cl.

CPC ..... *H01Q 21/28* (2013.01); *H01Q 1/521* (2013.01); *H01Q 1/243* (2013.01); *H01Q 1/38* (2013.01); *H01Q 1/48* (2013.01); *H01Q 13/10* (2013.01)

(58) Field of Classification Search

CPC ..... H01Q 1/40; H01Q 1/38; H01Q 1/22; H01Q 1/243; H01Q 21/28; G06K 19/07749

USPC ..... 343/873, 846, 702, 700 MS, 848

See application file for complete search history.

(56) References Cited

U.S. PATENT DOCUMENTS

| | | | | |
|---|---|---|---|---|
| 6,861,986 | B2 * | 3/2005 | Fang et al. | 343/700 MS |
| 7,855,696 | B2 * | 12/2010 | Gummalla et al. | 343/876 |
| 8,134,517 | B2 * | 3/2012 | Wang et al. | 343/846 |
| 8,395,555 | B2 * | 3/2013 | Hobson et al. | 343/702 |
| 8,779,986 | B2 * | 7/2014 | Fan et al. | 343/700 MS |
| 2009/0322639 | A1 | 12/2009 | Lai | |
| 2012/0162036 | A1 | 6/2012 | Yanagi et al. | |

FOREIGN PATENT DOCUMENTS

| | | |
|---|---|---|
| EP | 2 230 717 | 9/2010 |
| JP | 2006115182 | 4/2006 |
| TW | 201001800 | 1/2010 |
| WO | WO 02/05382 | 1/2002 |

OTHER PUBLICATIONS

European Search Report dated Jan. 27, 2014.

(Continued)

*Primary Examiner* — Huedung Mancuso

(74) *Attorney, Agent, or Firm* — McClure, Qualey & Rodack, LLP

(57) ABSTRACT

The present invention is related to a communication device which includes a ground element and an antenna system. The ground element includes a main ground plane and a protruded ground plane. The antenna system includes a first antenna and a second antenna. The first antenna includes a metal radiation element and is adjacent to the main ground plane of the ground element. The second antenna is a slot antenna and is formed in the protruded ground plane of the ground element. The protruded ground plane is adjacent to the first antenna.

10 Claims, 3 Drawing Sheets

(56) References Cited

OTHER PUBLICATIONS

English language translation of abstract of JP 2006115182 (published Apr. 27, 2006).

Chinese language office action dated Aug. 28, 2015, issued in application No. CN 201210365496.3.

* cited by examiner

COMMUNICATION DEVICE AND ANTENNAS WITH HIGH ISOLATION CHARACTERISTICS

CROSS REFERENCE TO RELATED APPLICATIONS

This Application claims priority of Taiwan Patent Application No. 101134407 filed on Sep. 20, 2012, the entirety of which is incorporated by reference herein.

BACKGROUND OF THE INVENTION

1. Field of the Invention

The disclosure generally relates to a communication device, and more particularly, relates to a communication device comprising a dual-antenna system with high isolation characteristics.

2. Description of the Related Art

When mobile technology transmission rates increase, more and more antennas are required to be designed into mobile devices in order to increase data transmission amounts. Accordingly, a general antenna system (e.g., a dual-antenna WWAN (Wireless Wide Area Network) system which has functions of dual-SIM (Subscriber Identity Module), dual-standby, and dual-talk) is preferably disposed at one end of a handheld device (e.g., the bottom of a mobile phone) so that the bandwidth and the SAR (Specific Absorption Rate) of the antenna system can easily meet requirements. However, it is difficult to improve the isolation of the antenna system for WWAN high bands (e.g., a GSM1800/1900 band). The main reason is for this, is that mutual coupling between antennas increases since surface currents on a ground plane of a mobile device are easily excited along an antenna system operating at high bands. Thus, maintaining a high amount of isolation and reducing mutual coupling and interference between antennas in a limited space of a mobile device are critical challenges for antenna designers.

BRIEF SUMMARY OF THE INVENTION

To solve the problems in the prior art, the invention provides a communication device comprising a first antenna and a second antenna that are both disposed at one end of the communication device. The two antennas have good isolation therebetween when operating in the WWAN high bands (e.g., a GSM1800/1900 band).

In a preferred embodiment, the invention is directed to a communication device, comprising: a ground element, comprising a main ground plane and a protruded ground plane; and an antenna system, comprising: a first antenna, comprising a metal radiation element, and being adjacent to the main ground plane of the ground element; and a second antenna, being a slot antenna, wherein the second antenna is formed in the protruded ground plane of the ground element, and the protruded ground plane is adjacent to the first antenna.

In some embodiments, the ground element substantially has an L-shape and is formed on a circuit board or on a dielectric substrate inside of the communication device. The communication device may further comprise an electronic component which is substantially disposed between the first antenna and the second antenna. In some embodiments, the electronic component is a data transmission component or a microphone in such a manner that the design space of the ground element is used effectively. In some embodiments, the first antenna is a monopole antenna, a shorted monopole antenna, or a loop antenna, wherein at least two sides of the first antenna are adjacent to the ground element. In some embodiments, the second antenna is an open slot antenna and has an open end disposed at a specific edge of the protruded ground plane, wherein the specific edge is not adjacent to the first antenna. The first antenna and the second antenna may operate in at least one same mobile communication band.

In the mobile communication band, since the first antenna comprises the metal radiation element, the first antenna is substantially a resonant antenna excited by electric currents. On the other hand, since the second antenna is a slot antenna, the second antenna is substantially another resonant antenna excited by magnetic currents. Accordingly, the first antenna and the second antenna of the invention can have good isolation therebetween. In some embodiments, the isolation in term of transmission coefficient S21 between the first antenna and the second antenna is lower than −16 dB.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are shown in detail as follows.

Figure 1A:
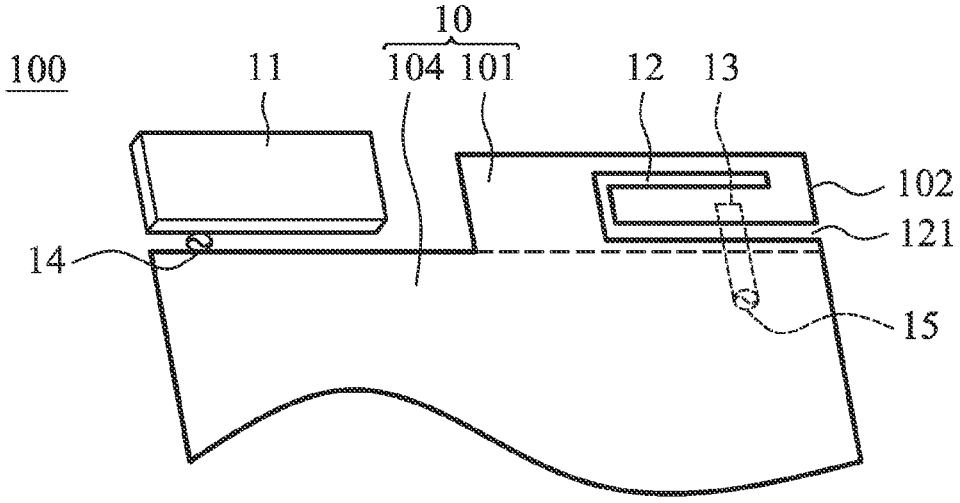
FIG. 1A is a diagram for illustrating a communication device according to a first embodiment of the invention.

FIG. 1A is a diagram for illustrating a communication device 100 according to a first embodiment of the invention. As shown in FIG. 1A, the communication device 100 comprises a ground element 10 and an antenna system. The ground element 10 comprises a protruded ground plane 101 and a main ground plane 104. The main ground plane 104 and the protruded ground plane 101 of the ground element 10 substantially form an L-shape. The antenna system comprises a first antenna 11 and a second antenna 12. In some embodiments, the first antenna 11 comprises a metal radiation element (not shown). The first antenna 11 is adjacent to the main ground plane 104 of the ground element 10. More particularly, at least two sides of the first antenna 11 are adjacent to the main ground plane 104 and the protruded ground plane 101 of the ground element 10, respectively. In some embodiments, the second antenna 12 is a slot antenna. The second antenna 12 is formed in the protruded ground plane 101 of the ground element 10, and the protruded ground plane 101 is adjacent to the first antenna 11. The first antenna 11 is excited by a first signal source 14, and the second antenna 12 is excited by a second signal source 15 through a feeding microstrip line 13. In some embodiments, the second antenna 12 is an open slot antenna and has an open end 121. The open end 121 of the second antenna 12 is disposed at a specific edge of the protruded ground plane 101, e.g., the edge 102, and the edge 102 is not adjacent to the first antenna 11. In this embodiment, the second antenna 12 further comprises a closed end 122, and the closed end 122 of the second antenna 12 is closer to the first antenna 11 than the open end 121 of the second antenna 12.

Figure 1B:
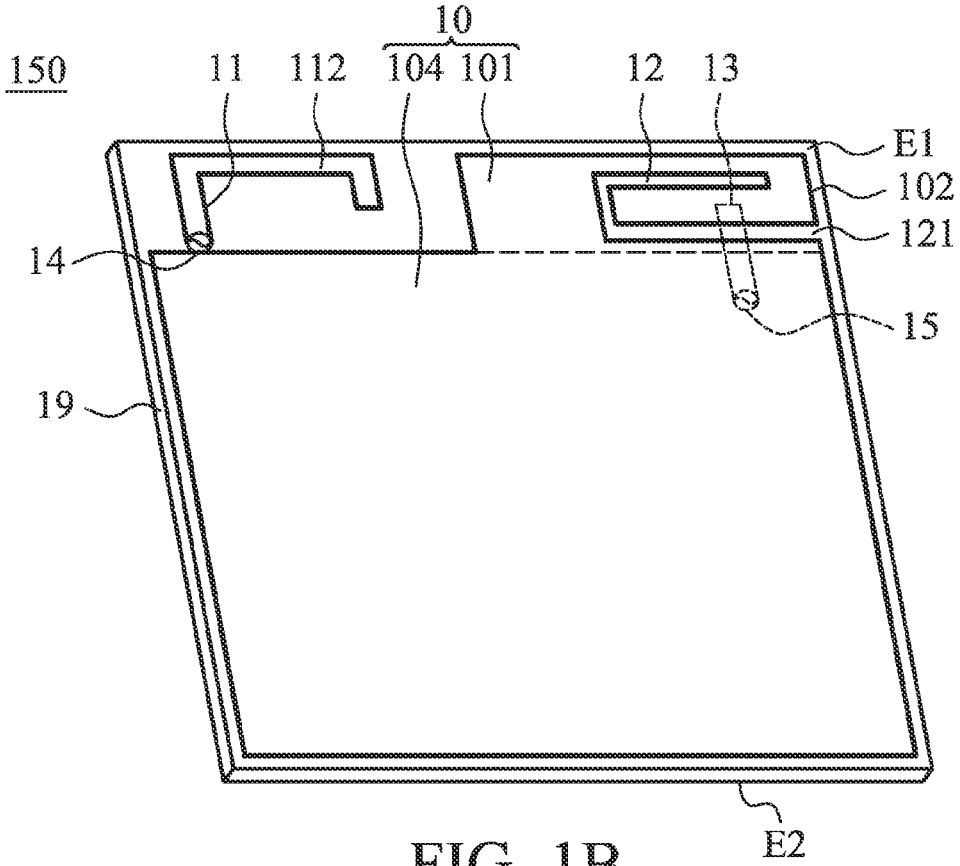
FIG. 1B is a diagram for illustrating a communication device according to a second embodiment of the invention.

FIG. 1B is a diagram for illustrating a communication device 150 according to a second embodiment of the invention. The second embodiment is similar to the first embodiment. As shown in FIG. 1B, the communication device 150 further comprises a circuit board 19 (or a dielectric substrate 19) which is disposed inside of the communication device 150. The ground element 10 is formed on the circuit board 19. More particularly, the circuit board 19 has two opposite surfaces E1 and E2. The ground element 10 is disposed on the surface E1 of the circuit board 19, and the feeding microstrip line 13 is disposed on the surface E2 of the circuit board 19. In the embodiment, the first antenna 11 comprises a metal radiation element 112 which substantially has an inverted J-shape. Note that the invention is not limited to the above. In other embodiments, the metal radiation element 112 may have other shapes, for example, a U-shape, an L-shape, a spiral shape, or an irregular shape. Other features of the communication device 150 in the second embodiment are similar to those in the first embodiment. Accordingly, the performance of the communication device 150 in the second embodiment is almost the same as that of the first embodiment.

Figure 2:
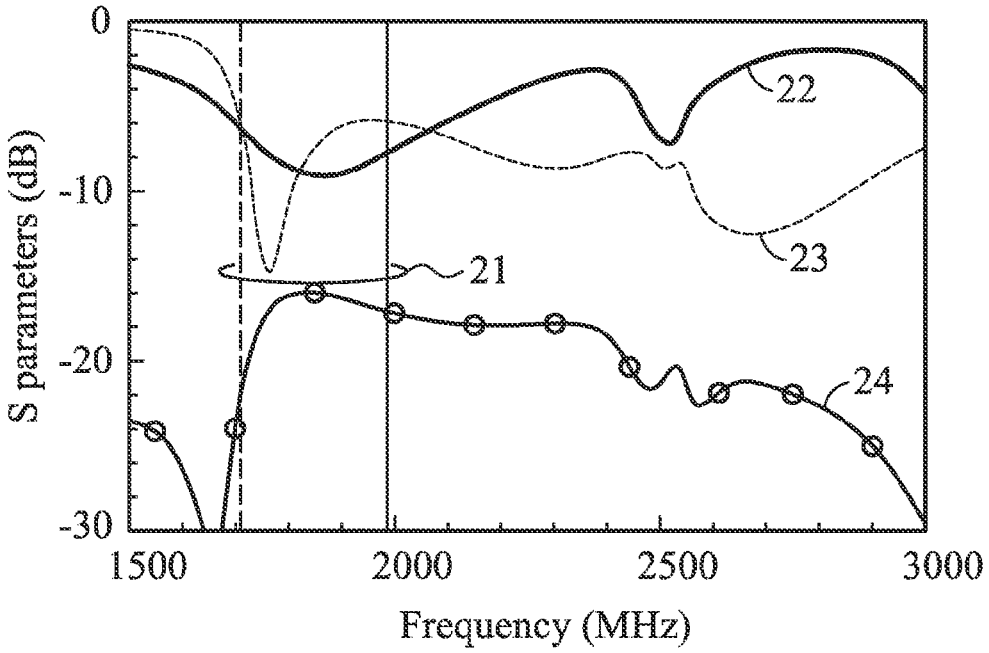
FIG. 2 is a diagram for illustrating S parameters of an antenna system of a communication device according to a first embodiment of the invention.

FIG. 2 is a diagram for illustrating S parameters of the antenna system of the communication device 100 according to the first embodiment of the invention. The horizontal axis represents operation frequency (MHz), and the vertical axis represents S parameters (dB). As shown in FIG. 2, the reflection coefficient (S11) curve 22 represents the reflection coefficient (S11) of the first antenna 11, and the reflection coefficient (S22) curve 23 represents the reflection coefficient (S22) of the second antenna 12, and the isolation (S21) curve 24 represents the isolation (S21) between the first antenna 11 and the second antenna 12. The first antenna 11 generates a resonant mode in at least one mobile communication band 21 (e.g., a GSM1800/1900 band). The second antenna 12 also generates a resonant mode in at least the mobile communication band 21. In a preferred embodiment, the isolation (S21) between the first antenna 11 and the second antenna 12 is lower than about −16 dB, and lower than about −20 dB, in the mobile communication band 21.

In some embodiments, the element sizes are as follows. The circuit board 19 has a length of about 110 mm, a width of about 60 mm, and a thickness of about 0.8 mm. The first antenna 11 has a length of about 25 mm, a width of about 10 mm, and a height of about 3 mm. A slot of the second antenna 12 has a length of about 23 mm. In some embodiments, the area occupied by the antenna system is merely about 600 $mm^2$ (60 mm by 10 mm) The antenna system of the invention is preferably disposed at a same edge of a smart phone, and furthermore, the antenna system is very thin and can be manufactured easily. Accordingly, the invention can be applied to a variety of slim mobile communication devices, for example, a mobile phone, a tablet computer, or a notebook computer. Note that the above element sizes, element parameters and frequency ranges are not limitations of the invention, and they may be adjusted by a designer according to different requirements.

Figure 3:
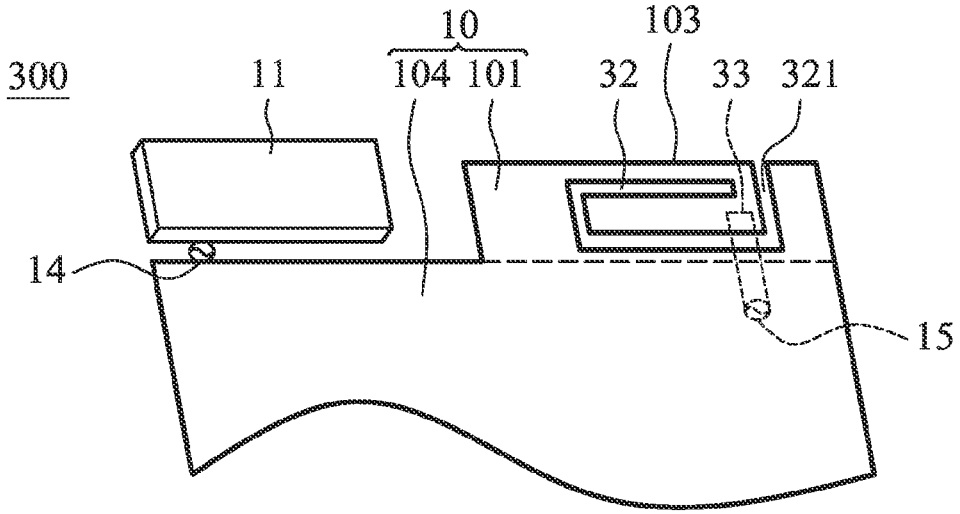
FIG. 3 is a diagram for illustrating a communication device according to a third embodiment of the invention.

FIG. 3 is a diagram for illustrating a communication device 300 according to a third embodiment of the invention. The third embodiment is similar to the first embodiment. The difference from the first embodiment is that an open end 321 of a second antenna 32 of the communication device 300 is disposed at another specific edge of the protruded ground plane 101, e.g., an edge 103. Similarly, the open end 321 of the second antenna 32 is not adjacent to the first antenna 11. In this embodiment, the second antenna 32 further comprises a closed end 322, and the closed end 322 of the second antenna 32 is closer to the first antenna 11 than the open end 321 of the second antenna 32. Other features of the communication device 300 in the third embodiment are similar to those in the first embodiment. Accordingly, the performance of the communication device 300 in the third embodiment is almost the same as that of the first embodiment.

Figure 4:
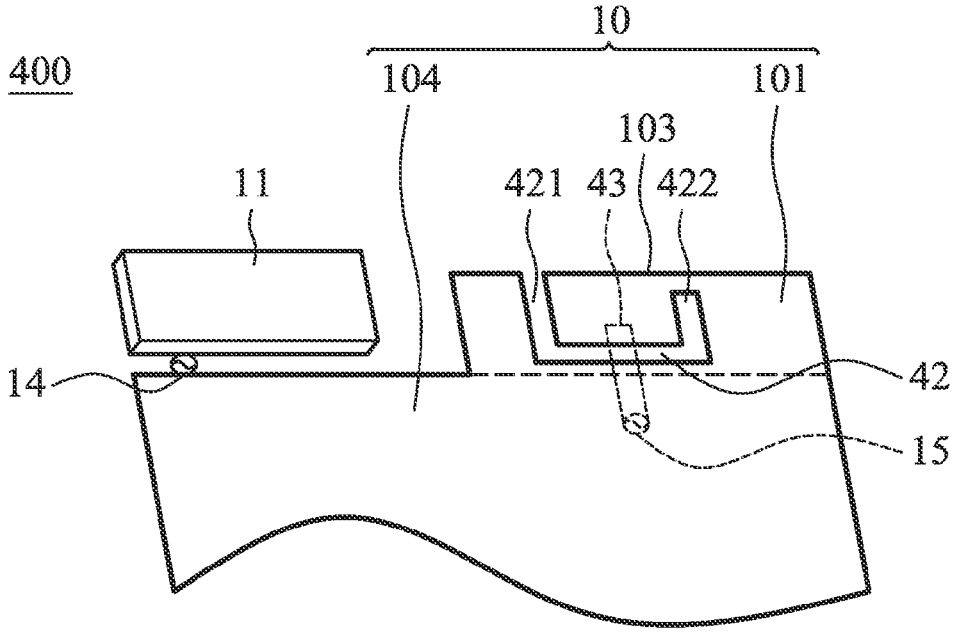
FIG. 4 is a diagram for illustrating a communication device according to a fourth embodiment of the invention.

FIG. 4 is a diagram for illustrating a communication device 400 according to a fourth embodiment of the invention. The fourth embodiment is similar to the first embodiment. The difference from the first embodiment is that an open end 421 of a second antenna 42 of the communication device 400 is disposed at another specific edge of the protruded ground plane 101, e.g., an edge 103. Similarly, the open end 421 of the second antenna 42 is not adjacent to the first antenna 11. In the fourth embodiment, the open end 421 of the second antenna 42 is closer to the first antenna 11 than a closed end 422 of the second antenna 42. Other features of the communication device 400 in the fourth embodiment are similar to those in the first embodiment. Accordingly, the performance of the communication device 400 in the fourth embodiment is almost the same as that of the first embodiment.

Figure 5:
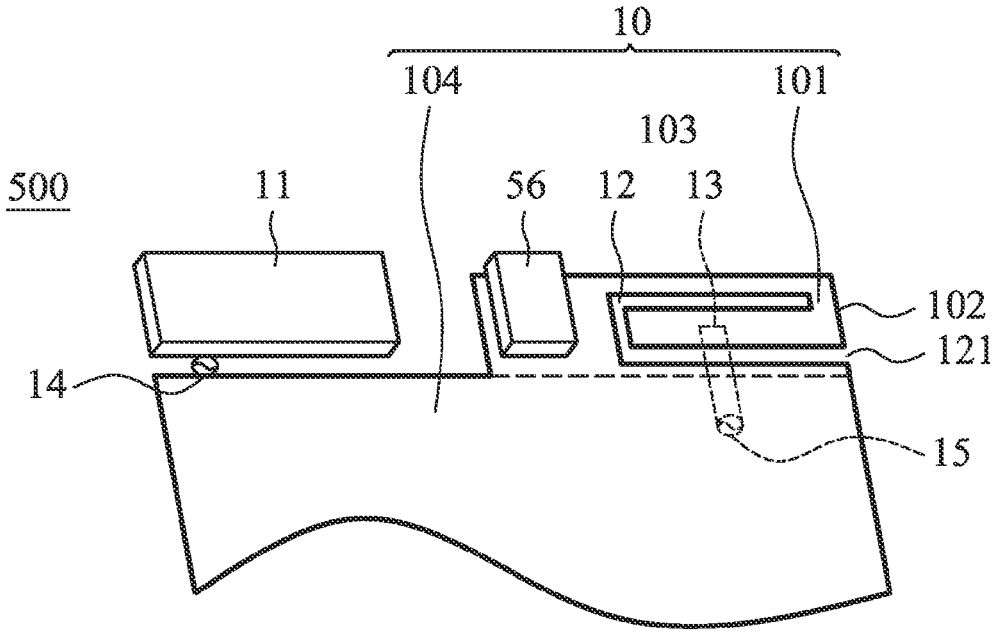
FIG. 5 is a diagram for illustrating a communication device according to a fifth embodiment of the invention.

FIG. 5 is a diagram for illustrating a communication device 500 according to a fifth embodiment of the invention. The fifth embodiment is similar to the first embodiment. The difference from the first embodiment is that the communication device 500 further comprises an electronic component 56. As shown in FIG. 5, the electronic component 56 is disposed on the protruded ground plane 101 of the ground element 10, and the electronic component 56 is substantially disposed between the first antenna 11 and the second antenna 12. In some embodiments, the electronic component 56 is a data transmission component or a microphone, and the electronic component 56 is disposed in such a manner that the design space of the ground element 10 is used effectively and the antenna system is integrated with relative electronic components. Other features of the communication device 500 in the fifth embodiment are similar to those in the first embodiment. Accordingly, the performance of the communication device 500 in the fifth embodiment is almost the same as that of the first embodiment.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element, comprising a main ground plane and a protruded ground plane; and an antenna system, comprising:

a first antenna, comprising a metal radiation element, and being adjacent to the main ground plane of the ground element; and a second antenna, being an open slot antenna, wherein the second antenna is formed in the protruded ground plane of the ground element, and the protruded ground plane is adjacent to the first antenna;

wherein the second antenna has an open end disposed at a specific edge of the protruded ground plane, wherein the specific edge is not adjacent to the first antenna;

wherein the communication device further comprises an electronic component, the electronic component is substantially disposed between the first antenna and the second antenna, and the electronic component is a data transmission component or a microphone.

2. The communication device as claimed in claim 1, wherein the first antenna and the second antenna operate in at least one same mobile communication band, and the mobile communication band is a GSM1800/1900 band.

3. The communication device as claimed in claim 1, wherein the first antenna is a monopole antenna.

4. The communication device as claimed in claim 1, wherein the first antenna is a shorted monopole antenna.

5. The communication device as claimed in claim 1, wherein the first antenna is a loop antenna.

6. The communication device as claimed in claim 1, wherein the first antenna has an inverted J-shape.

7. The communication device as claimed in claim 1, wherein at least two sides of the first antenna are adjacent to the main ground plane and the protruded ground plane of the ground element, respectively.

8. The communication device as claimed in claim 1, wherein the second antenna further comprises a closed end, and the closed end of the second antenna is closer to the first antenna than the open end of the second antenna.

9. The communication device as claimed in claim 1, wherein the second antenna further comprises a closed end, and the open end of the second antenna is closer to the first antenna than the closed end of the second antenna.

10. The communication device as claimed in claim 1, wherein the main ground plane and the protruded ground plane of the ground element substantially form an L-shape.

* * * * *